US008904713B1

(12) United States Patent
Anderson

(10) Patent No.: US 8,904,713 B1
(45) Date of Patent: Dec. 9, 2014

(54) REINFORCING SYSTEM FOR DOOR AND DOOR JAMB

(71) Applicant: Edward Anderson, Chesapeake, VA (US)

(72) Inventor: Edward Anderson, Chesapeake, VA (US)

( * ) Notice: Subject to any disclaimer, the term of this patent is extended or adjusted under 35 U.S.C. 154(b) by 0 days.

(21) Appl. No.: 13/934,740

(22) Filed: Jul. 3, 2013

(51) Int. Cl.
*E05B 15/02* (2006.01)
*E05B 17/20* (2006.01)

(52) U.S. Cl.
CPC ..... *E05B 17/2084* (2013.01); *E05B 15/0205* (2013.01)
USPC ..... 49/462; 49/460; 49/461; 292/340; 292/341

(58) Field of Classification Search
USPC ..... 49/460–462
See application file for complete search history.

(56) References Cited

U.S. PATENT DOCUMENTS

| | | | | | |
|---|---|---|---|---|---|
| 306,806 | A | | 10/1884 | Barnes | |
| 1,238,924 | A | | 9/1917 | Kennedy | |
| 1,863,487 | A | | 6/1932 | Russell | 292/346 |
| 2,127,891 | A | * | 8/1938 | Starling | 292/346 |
| 2,217,891 | A | | 8/1938 | Starling | 292/341.18 |
| 2,486,772 | A | | 11/1949 | Wuerl | 292/341.18 |
| 2,726,892 | A | | 5/1954 | Zynda et al. | |
| 2,695,808 | A | * | 11/1954 | Manchester | 292/341.18 |
| 3,007,732 | A | | 3/1959 | Schlage | |
| 3,241,873 | A | * | 3/1966 | Russell et al. | 292/340 |
| 3,257,139 | A | * | 6/1966 | Russell et al. | 292/341.18 |
| 3,316,007 | A | | 4/1967 | Russell | |
| 3,524,669 | A | | 5/1968 | Reid | 292/346 |
| 3,506,293 | A | * | 4/1970 | Armstrong et al. | 292/341.19 |
| 3,792,893 | A | | 2/1974 | Grotnes | 292/256.61 |
| 3,939,752 | A | | 2/1976 | Koscik | 85/5 R |
| 3,963,269 | A | | 6/1976 | Rosenberg | 292/346 |
| 4,045,065 | A | | 8/1977 | Johnson | 292/341.17 |
| 4,074,484 | A | | 2/1978 | Queren | 52/214 |
| 4,105,235 | A | | 8/1978 | Thiel | 292/341.18 |
| 4,195,870 | A | | 4/1980 | Percoco | 292/340 |
| RE30,326 | E | | 7/1980 | Van Buren, Jr. | 220/326 |
| 4,223,494 | A | | 9/1980 | Wendt | 52/211 |
| 4,281,480 | A | | 8/1981 | Wendt | 49/504 |
| 4,415,191 | A | | 11/1983 | Thorp | 292/346 |
| 4,416,087 | A | | 11/1983 | Ghatak | 49/462 |
| 4,438,597 | A | | 3/1984 | Maggart | 49/501 |
| 4,489,517 | A | | 12/1984 | Young | 49/382 |

(Continued)

OTHER PUBLICATIONS

Pride Barco Lock Co., Model K-25Drill Template, (http://web.archive.org/web/20100710142242/http://www.pridebarco.com/drill_template.html), Retrieved using Internet Wayback Machine.

*Primary Examiner* — Katherine Mitchell
*Assistant Examiner* — Marcus Menezes
(74) *Attorney, Agent, or Firm* — MacCord Mason PLLC

(57) ABSTRACT

A mechanism to be applied to a door jamb that is opposed by a door edge to strengthen the door jamb to survive forced entry efforts includes two elongated, narrow plates sized for mounting on a door jamb surface. One plate has a protruding ramp configured to serve as a strike plate for a latch bolt mounted in the door and a bolt hole near the ramp. The second plate has an inner overlay and a perpendicular outer flange, forming an L-shaped cross-section. The inner overlay has a bolt hole, and a slot in the outer flange near the overlay's bolt hole receives the ramp when the plates are nested. The bolt holes in the plates align, as do additional holes in the plates to receive screws to hold the plates mounted to the door jamb.

14 Claims, 7 Drawing Sheets

(56) References Cited

U.S. PATENT DOCUMENTS

| | | | | | |
|---|---|---|---|---|---|
| D283,299 | S | | 4/1986 | Mazie | D8/343 |
| 4,631,866 | A | | 12/1986 | Otto et al. | 49/504 |
| 4,635,399 | A | | 1/1987 | Gehrke et al. | 49/460 |
| 4,640,052 | A | * | 2/1987 | Zebedee et al. | 49/383 |
| 4,673,204 | A | | 6/1987 | Allenbaugh | 292/346 |
| 4,690,445 | A | | 9/1987 | Hartley | 292/341 |
| 4,717,185 | A | | 1/1988 | Hartley | 292/340 |
| 4,720,129 | A | | 1/1988 | Bouchard | 292/346 |
| 4,813,826 | A | | 3/1989 | Riedel | 408/108 |
| 4,858,384 | A | | 8/1989 | Blankenship | 49/460 |
| 4,869,087 | A | * | 9/1989 | Day | 70/417 |
| 4,947,606 | A | * | 8/1990 | La See | 52/455 |
| 4,953,901 | A | * | 9/1990 | Hegdahl | 292/340 |
| 5,070,650 | A | * | 12/1991 | Anderson | 49/460 |
| 5,076,626 | A | | 12/1991 | Tiddy et al. | 292/337 |
| 5,094,489 | A | | 3/1992 | Jones | 292/340 |
| 5,114,285 | A | | 5/1992 | Brydon | 408/115 R |
| 5,171,050 | A | | 12/1992 | Mascotte | 292/341.18 |
| 5,222,845 | A | | 6/1993 | Goldstein et al. | 408/103 |
| 5,241,790 | A | | 9/1993 | Schimpf | 49/504 |
| 5,344,198 | A | * | 9/1994 | Elliott | 292/340 |
| 5,456,507 | A | | 10/1995 | Jones | 292/349 |
| 5,474,347 | A | | 12/1995 | Vigneault et al. | 292/340 |
| D372,191 | S | | 7/1996 | Bennett | D8/403 |
| 5,566,509 | A | | 10/1996 | Long | 49/462 |
| 5,566,995 | A | | 10/1996 | Jagiela | 292/346 |
| 5,581,948 | A | | 12/1996 | Simonsen | 49/460 |
| 5,586,796 | A | | 12/1996 | Fraser | 292/346 |
| 5,645,330 | A | | 7/1997 | Artwohl et al. | 312/115 |
| 5,915,764 | A | | 6/1999 | MacDonald | 292/66 |
| 5,934,024 | A | | 8/1999 | Simpson | 49/462 |
| 6,085,465 | A | | 7/2000 | Olberding et al. | 49/460 |
| 6,176,527 | B1 | | 1/2001 | Bench | 292/340 |
| 6,185,881 | B1 | | 2/2001 | Olberding et al. | 52/294.1 |
| 6,305,127 | B1 | | 10/2001 | Olberding et al. | 49/461 |
| 6,679,004 | B1 | | 1/2004 | Olberding et al. | 49/460 |
| 6,691,466 | B2 | | 2/2004 | Childress | 49/462 |
| 6,698,807 | B1 | | 3/2004 | Wacker | 292/341.14 |
| 6,834,897 | B1 | | 12/2004 | Walker | 292/340 |
| 6,901,706 | B2 | | 6/2005 | Olberding et al. | 49/460 |
| 7,000,959 | B2 | | 2/2006 | Sanders | 292/340 |
| 7,421,791 | B2 | | 9/2008 | Adkins et al. | 33/197 |
| 7,866,113 | B2 | | 1/2011 | Young | 52/656.4 |
| 8,132,832 | B2 | * | 3/2012 | Anderson | 292/340 |
| 8,166,707 | B2 | | 5/2012 | Franschman | 49/460 |
| 2005/0011132 | A1 | | 1/2005 | Griffin | 49/460 |
| 2006/0214437 | A1 | | 9/2006 | Farzan | 292/340 |
| 2008/0089752 | A1 | | 4/2008 | Rusiana et al. | 408/115 R |
| 2008/0224486 | A1 | | 9/2008 | Anderson | 292/340 |
| 2008/0284182 | A1 | | 11/2008 | Canerdy, Jr. | 292/346 |

* cited by examiner

REINFORCING SYSTEM FOR DOOR AND DOOR JAMB

BACKGROUND OF THE INVENTION

Most doors used in construction today are of the "pre-hung" type. More particularly, the door and door frame are prefabricated and are sold as a unit. The entire door and door frame unit is then installed by the purchaser. A large percentage of these pre-hung doors are made entirely of wood and are installed as entry doors. While entry doors are intended to function to exclude uninvited guests when locked, they are often inadequate for that purpose.

Entry doors, particularly residential entry doors, typically include both a primary door knob lock assembly, or lockset, and a supplemental deadbolt. Typically, when an entry door is closed, the lockset latch bolt protrudes from the entry door into an appropriate opening in a strike plate. The strike plate is typically affixed to the door jamb of the door casing by two screws.

A deadbolt typically acts as a supplemental lock to ensure that the entry door remains closed. When the deadbolt is activated, the deadbolt latch bolt protrudes from the entry door into an appropriate opening in another strike plate attached to the door frame.

Unfortunately, even when lock sets and deadbolts are used, it can be relatively easy for an intruder, such as a burglar, to gain entry to the dwelling or business by forcefully kicking the door in the general vicinity of the door lock latch bolt and/or the deadbolt latch bolt, thereby breaking the door jamb where the strike plates are located and allowing the door to be opened.

Two ways to ameliorate this problem were described in my prior U.S. Pat. Nos. 5,070,650 and 8,132,832, the entire disclosures of which are incorporated herein by reference. In particular, the latter patent shows how to include a strike plate with a door jamb reinforcing system, but applicant has found that there are inefficiencies in the manufacture of that mechanism. One of the problems encountered with reinforcing both the door and the jamb is that adding either reinforcement of a conventional design narrows the small gap between the door and the jamb, so there is not sufficient room to add the second reinforcement.

SUMMARY OF THE INVENTION

The present invention fulfills one or more needs in the art by providing a mechanism to be applied to a door jamb that is opposed by a door edge to strengthen the door jamb to survive forced entry efforts. A first elongated, narrow plate is sized for mounting on a door jamb surface that is opposed by a door edge and has a protruding ramp configured to serve as a strike plate for a latch bolt mounted in a co-operating door. A bolt hole in the first plate proximate the ramp is located to receive the latch bolt when the opposed door is closed. A second elongated narrow plate has an inner overlay and a perpendicular outer flange, forming an L-shaped cross-section. A bolt hole in the inner overlay is positioned to receive the latch bolt when the co-operating door is closed, and a slot in the outer flange proximate the bolt hole in the inner overlay is sized to receive the ramp of the first plate when the first plate is nested with the second plate and the bolt hole in the first plate and bolt hole in the inner overlay are aligned. Both the first and second plates have holes that are sized to receive screws to hold the plates mounted to the door jamb and that are positioned in the first and second plates to align when the bolt holes in the first and second plates are aligned.

The first plate may have at least one additional bolt hole for a deadbolt and the second plate may haves at least one deadbolt latch bolt hole and a plug that substantially fills and is held in place within the at least one the deadbolt latch bolt receiving aperture. In another version, the first plate has at least one additional bolt hole for deadbolts and the second plate has at least one additional bolt hole for deadbolts.

Preferably, the holes in the second plate that are sized to receive screws are countersunk.

The bolt hole in the second plate may include a latch bolt adjustment tab.

The invention can also be considered as a kit for protecting against the breakage of a door jamb and cooperating door that has an installed door knob lock assembly adjacent the door edge. The kit includes a first elongated, narrow plate sized for mounting on the door jamb surface that is opposed by a co-operating door edge. The first plate has a protruding ramp configured to serve as a strike plate for a latch bolt mounted in co-operating door and a bolt hole in the first plate proximate the ramp to receive the latch bolt when the co-operating door is closed. A second elongated narrow plate has an inner overlay and a perpendicular outer flange, forming an L-shaped cross-section. A bolt hole in the inner overlay is positioned to receive the latch bolt when the co-operating door is closed, and a slot in the outer flange proximate the hole in the inner overlay is sized and positioned to receive the ramp of the first plate when the first plate is nested with the second plate and the bolt hole in the first plate and bolt hole in the inner overlay are aligned. Both the first and second plates have holes that are sized to receive screws to hold the plates mounted to the door jamb and that are positioned to align when the bolt holes in the first and second plates are aligned. In addition, the kit includes first and second metal plates for mounting on the cooperating door. The first and second metal plates each have one long dimension long enough to span a door knob lock assembly on the co-operating door to define upper and lower ends and a width narrow enough to fit between the door knob and the door edge. The first and second metal plates have a connection means to enable the first and second metal plates to be fastened to each other through holes in the cooperating door, thereby reinforcing the door around the door knob lock assembly to reduce the likelihood of door breakage during an attempted forced entry. Since the door reinforcement does not extend into the gap between the door and the jamb as is the case with wrap-around reinforcements, collisions between the two reinforcements are avoided.

One version of the connection means includes hole of a first diameter near each of the upper and lower ends of the first and second plates, and two connectors that each include a male component and a female component. The male component has outer threads and the female component has inner threads, so the male component may be engaged to the female component. The female component has a shaft. One of the male and female components has a plain head so it cannot be engaged by a screwdriver, and the other of the male and female components has a head that can be engaged by a screwdriver.

Another version of the connection means includes holes of a first diameter near each of the upper and lower ends of the first plate, and female components surface mounted on the second plate. The kit includes two male components having outer threads, and the female component having a shaft with inner threads, so the male component may be engaged to the female component.

The kit may include a three-fold template having a first side to fit on the outside of the cooperating door, a second side to fit on the door edge and a third side to fit on the inside of the door. The second side of the template has a first guide to guide placement of the template so that a lockset latch bolt of the door knob lock assembly can pass through a hole in the template, thereby defining a locus for the template on the door. The template further has a second guide for placement of the metal plates on the door for mounting. The guide for placement of the metal plates on the door for mounting is an edge of the template. In a preferred embodiment the template is 3½ inches by four inches, so that it folds to make the first and third sides ⅞ inch by four inches and the second side is 1¾ inch by 4 inch, enabling the template to be suitable for locating the metal plates on a door 1¾ thick.

The invention can also be considered as a kit for protecting against the breakage of a co-operating door having an installed door knob lock assembly adjacent the door edge. First and second metal plates for mounting on the cooperating door have one long dimension long enough to span the door knob lock assembly to define upper and lower ends and a width narrow enough to fit between the door knob and the door edge. The metal plates have a connection means to enable the first and second metal plates to be fastened to each other through holes in the cooperating door, thereby reinforcing the door around the door knob lock assembly to reduce the likelihood of door breakage during an attempted forced entry.

The first and second plates may be generally rectangular. In one embodiment the plates are about four inches long and about ⅞ inch wide.

The invention can also be considered as a kit for protecting against the breakage of a door jamb and cooperating door that has an installed door knob lock assembly adjacent the door edge. An elongated, first narrow plate has a width narrow enough for mounting on the door jamb surface that is opposed by a co-operating door edge and a length that extends at least two feet. The first plate has holes that are sized to receive screws to hold the plate mounted to the door jamb. The kit includes second and third shorter plates for mounting on the cooperating door. These plates have a length long enough to span the door knob lock assembly to define upper and lower ends and a connection means to enable the second and third plates to be fastened to each other through holes in the cooperating door, thereby reinforcing the door around the door knob lock assembly to reduce the likelihood of door breakage during an attempted forced entry. The second and third plates have a width narrow enough to fit between the door knob and the door edge and narrow enough so that when mounted to the co-operating door, the second and third plates to not extend past the edge of the door where they could collide with an installed first plate on the door jamb.

BRIEF DESCRIPTION OF THE DRAWINGS

The invention will be better understood by a reading of the Detailed Description of the Examples of the Invention along with a review of the drawings, in which.

DETAILED DESCRIPTION OF EXAMPLES OF THE INVENTION

Figure 1:
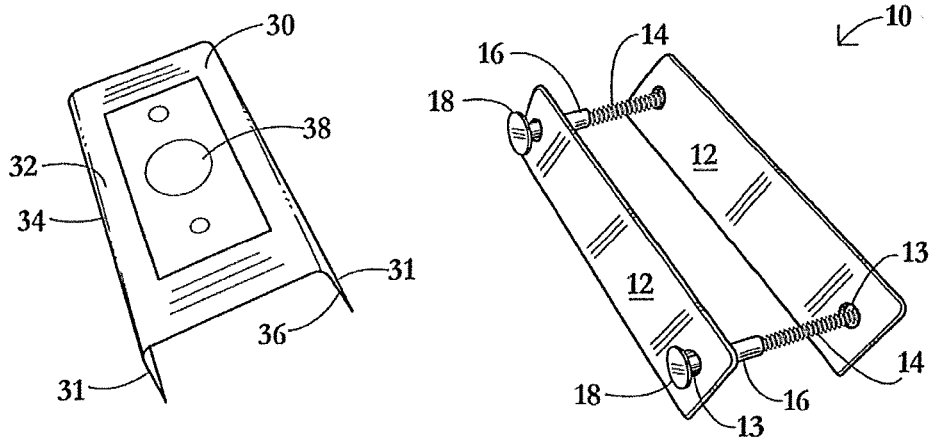
FIG. 1 is a perspective view of the kit elements of a preferred embodiment of the door edge protector, partially assembled, but without the door to which it would mount.

An embodiment of the present invention provides a kit of materials to allow a door having a door knob lock assembly adjacent the door edge in conventional fashion to be reinforced to reduce the likelihood of door breakage during an assault. As seen in FIG. 1, the kit 10 includes two plates 12 that each have holes 13 on either end.

The plates 12 are preferably three quarters inch wide and four inches long. That width enables the plate to fit between the door knob and the edge of the door, where the latch bolt presence causes door weakness. Four inches has been found to be adequate to extend the height of the latch bolt assembly and extend over the latch bolt itself. However, other dimensions can be used, if desired. In particular, for other door knob lock assemblies, other sizes may be useful. The width need not extend to the door edge when installed.

Figure 2:
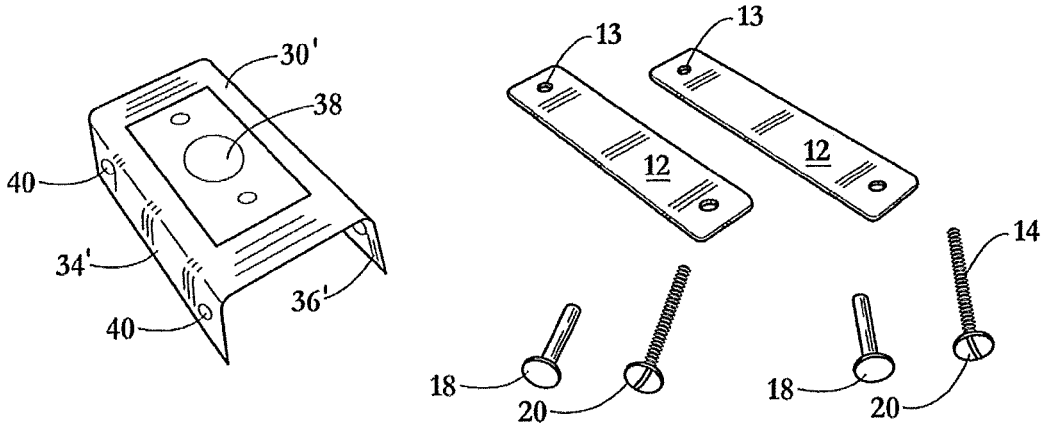
FIG. 2 is a perspective view of the kit elements of an alternate embodiment.

FIG. 1 also shows the connectors including a female connector 18 and a male connector 14. The female connector 18 has a head that is plain, and the male connector has a head 20 that is slotted to receive a screwdriver. These elements are seen in FIG. 2 and are the same as those as depicted in FIG. 1. Similarly, the plates 12 in FIG. 2 are the same as the plates seen in FIG. 1. FIG. 1 also shows a template 30 which is a three-fold element having a first side 34, a second side 32 and a third side 36. The template second side 32 is configured to be the width of the door thickness, so that the template can be wrapped on the edge of the door with the two side panels 34 and 36 on the front and back of the door while the second panel 32 is on the door edge. The second panel 32 has a guide 38 in the form of a cut-out located to allow the latch bolt of the door assembly to pass through the guide 38. The template 30 can be mounted on a defined location on the door, defined by the location of the latch bolt. That then defines a location for the top edges 31 of first and third panels 34, 36. That top edge can be marked on the door with a pencil, to mark where the top of the plate 12 is to be placed. Then additional marks are made on the door through the holes 13 in the plates 12.

FIG. 2 shows an alternate embodiment of the template in which the panels 34' and 36' have holes 40 cut in them in specific locations. These holes define a location corresponding to the intended location holes 13 for the plates, and indicate locations to be marked on the door to enable the door to be drilled to receive the connectors 18 and 20 that mount the plates 12 on the door. Otherwise, the template 30' is identical to the template 30. However, since the function of defining where the holes are to be drilled in the door is carried out by the holes 40, the top edge 31 need not be located with specificity.

Figure 3:
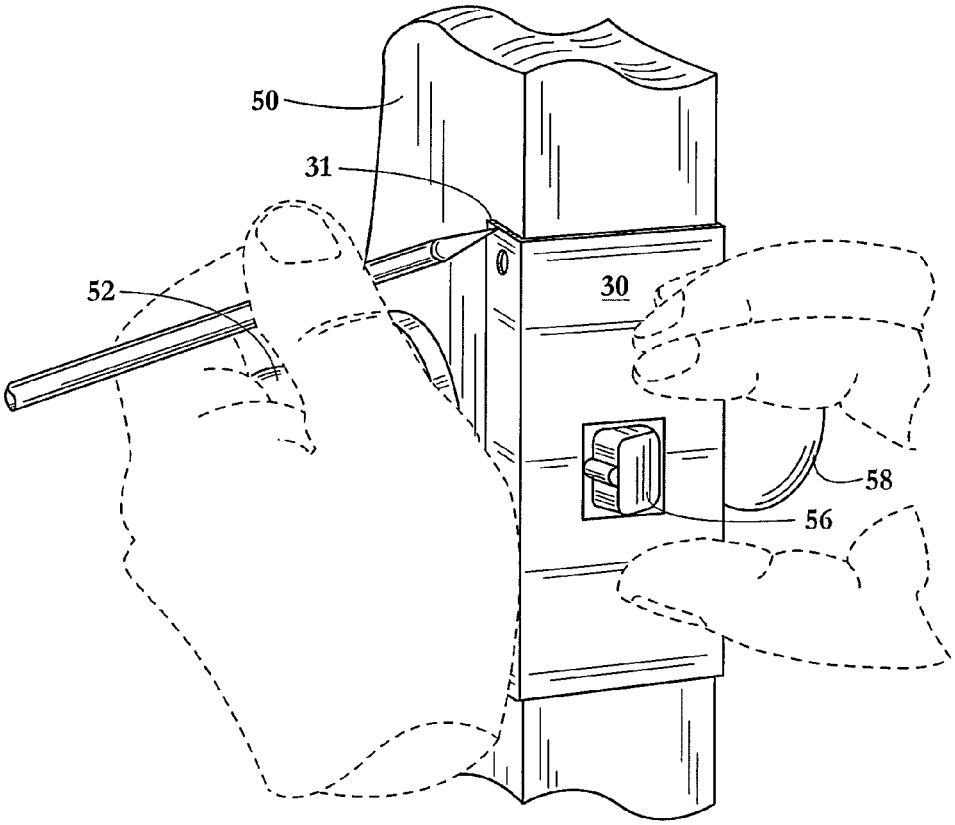
FIG. 3 is a perspective view of a door to receive the kit elements of the embodiment of FIG. 1 or FIG. 2, showing placement of the template.

FIG. 3 shows a first step in the mounting of a kit on a door 50. The template 30 is located with the latch bolt 56 passing through the guide 38. Thus, this locates the top edges 31 of the template of the front and back of the door. A user can then mark with a pencil where those locations are on the front and back of the door. Note that the sides 34 and 36 of the templates are located between the inner doorknob 52 and the door edge.

Figure 4:
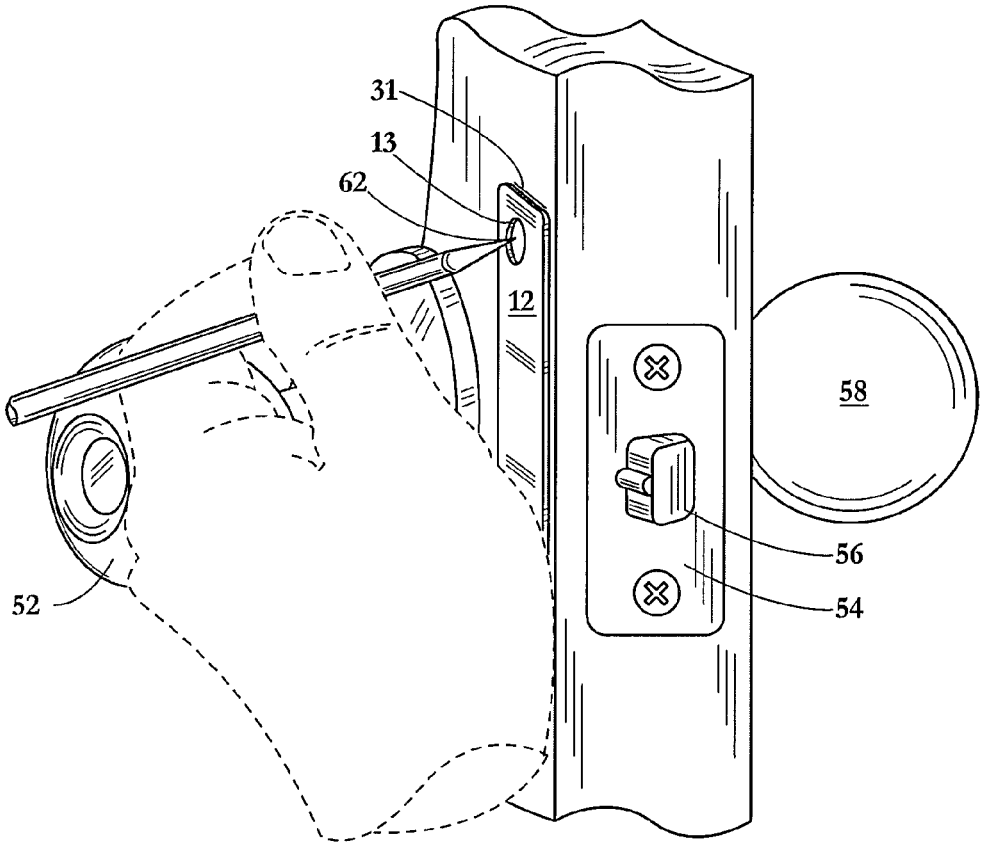
FIG. 4 is a perspective view of a door to receive the kit elements of the embodiment of FIG. 1, showing placement of the metal plate during a marking step.

FIG. 4 shows the next step in the application of the kit. In this step, the marks made at lines 31 use to guide the placement of the plates 12 temporarily. At this stage, the holes 13 of the plates are properly positioned and then can be marked with a mark 62 at inside the hole 13 by a pencil, as shown. In the marking step, preferably marks are made on both the inside and the outside for both of the two holes 13 in the plates 12. Note that the plate 12 does not extend to the door edge.

The next step in the method includes using a drill to drill at the marks 62 into the door. The first drilling goes half way through the door at one mark and then a follow up drilling from the other side's mark enables the entire bore to be made through the door. In the preferred embodiment, the hole is made with a quarter inch drill bit.

Figure 5:
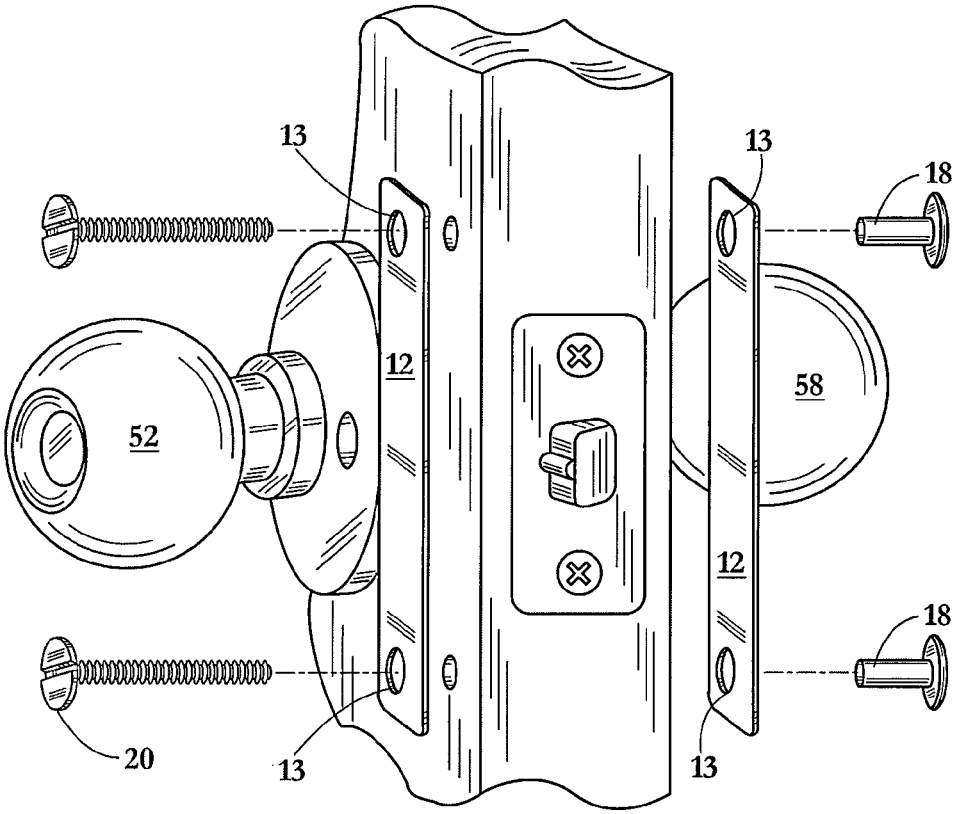
FIG. 5 is an exploded, perspective view of a door to receive the kit elements of the embodiments of FIG. 1, showing the second plate being held onto the door by screwing the connector elements together.

FIG. 5 shows the completion of the mounting in which the two opposed plates 12 are in place, with connectors 14 and 18 passing through them and internally of the door. The female connectors with their plain heads 18 are passed through the plate 12 on the outside of the door. The male connectors with their slotted heads 20 are passed through the holes 13 on the inside of the door through their plate 12. The female connectors 18 have internal threads that match the external threads of the male connectors 14. By placing the plain heads of the female connectors on the outside, intruders cannot simply unscrew the connector to weaken the door. The kit can be configured so that the plain connector on the outside is the male member with the inside connector being the female member with a slotted head, in an alternate embodiment, not shown.

In the embodiment of FIG. 2, the marking steps shown in FIGS. 3 and 4 are condensed, so that the marking where the holes are to be drilled can be made directly through the holes 40 in the template.

The two plates 12, being compressed against the wooden core and spanning the latch bolt, substantially increase the strength of the door in that otherwise vulnerable area, and reduce the likelihood of door breakage by a kick by an intruder.

The invention is suitable for normal single entry doors, and is particularly useful in connection with French doors.

Alternate materials of construction of the plates 12 may include one or more of the following: steel, stainless steel, aluminum, titanium, and/or other metals, as well as various alloys and composites thereof. The connectors 14, 18 can be conventional connector materials. The template can be cardboard. Paper or other sheet material will also work.

Figure 6:
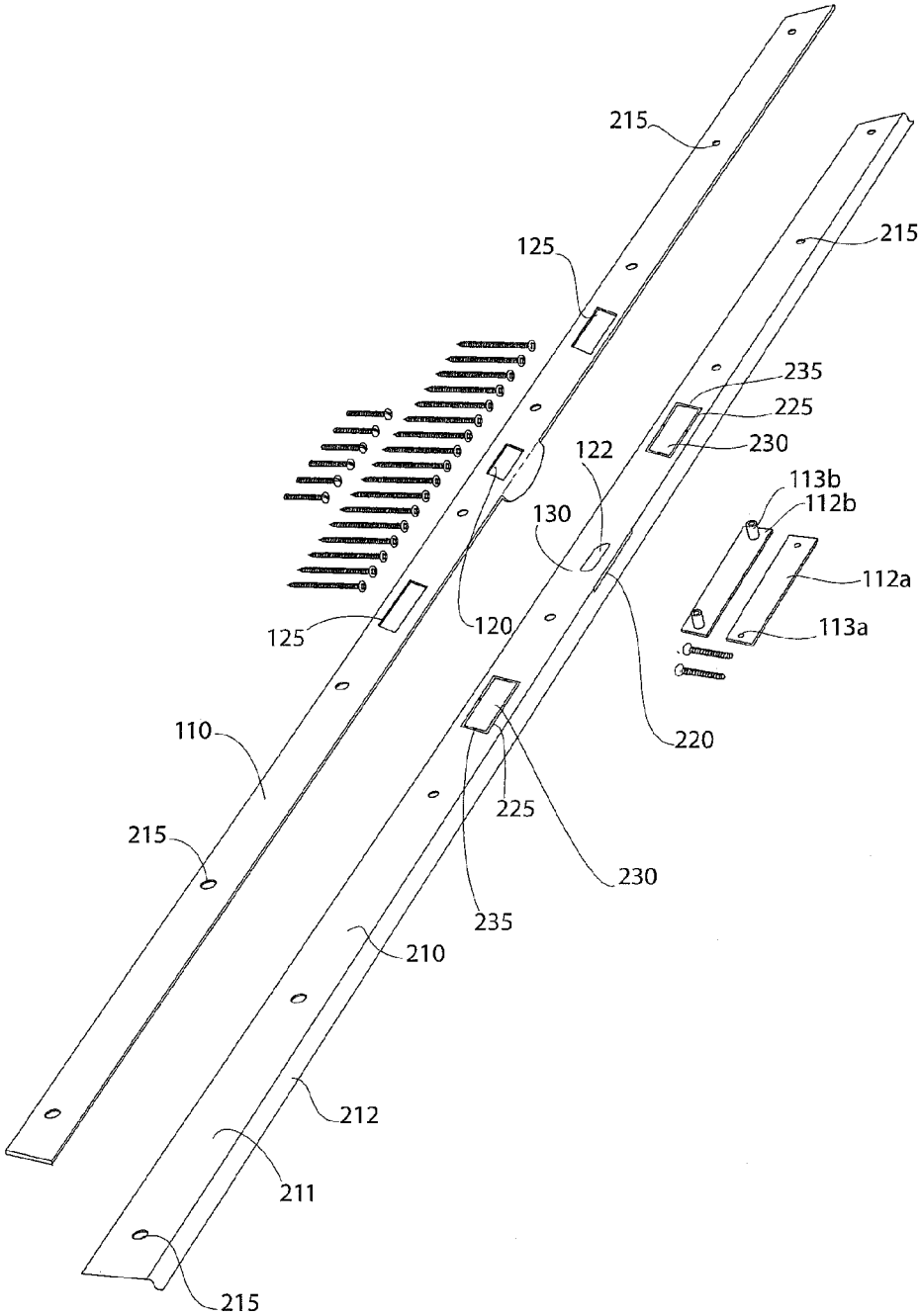
FIG. 6 is a perspective view of a kit of components for a reinforcing system for a door jamb in accordance with an embodiment of the invention, including in the kit a revised version of the kit shown in FIGS. 1-5; that revised version can be used independently of the door jamb reinforcement.
Figure 7:
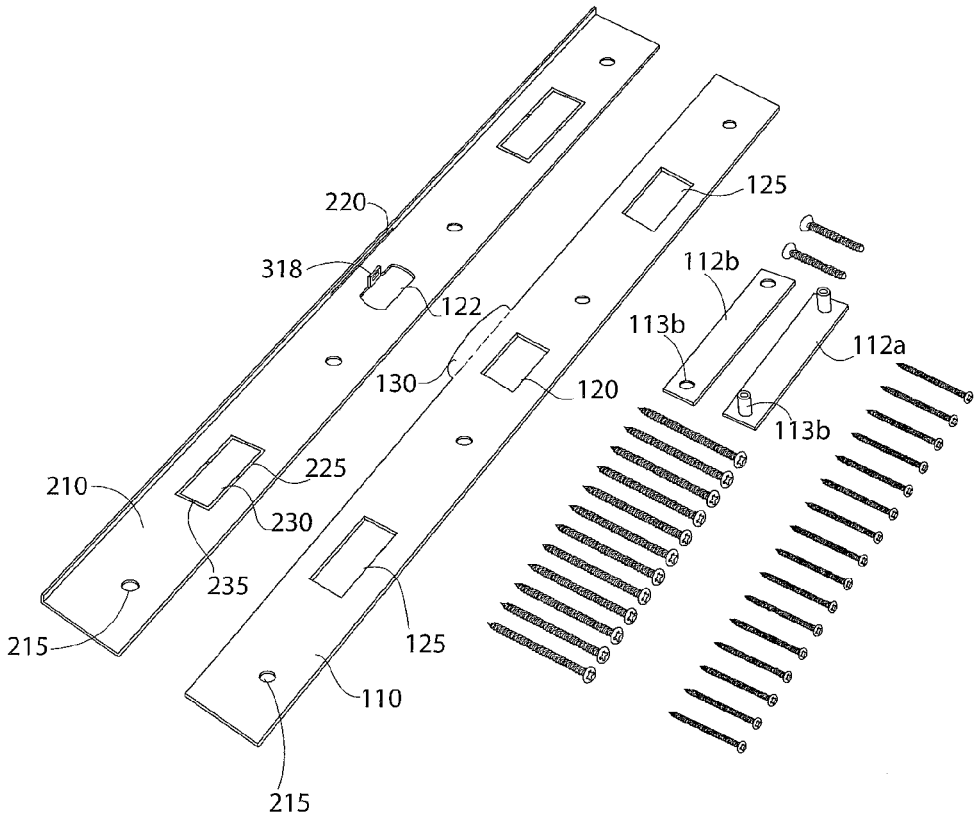
FIG. 7 is a perspective view of a kit similar to the kit of FIG. 6, showing some components from a reverse side.

In the embodiments shown in FIGS. 6 and 7, the first and second metal plates have a connection means to enable the first and second metal plates to be fastened to each other through holes in the cooperating door. First metal plate 112*a* has holes 113*a* of a first diameter near each of the upper and lower ends of the first plate. The female components 113*b* are surface mounted on the second plate 112*b*. As with the earlier-described embodiment, the kit includes two male components having outer threads, and the female components 113*b* have inner threads, so the male component may be engaged to the female component, and to the second plate 112*b*. This form allows the side of the second plate 112*b* that is not shown to be smooth and flat, so that second plate 112*b* nearly disappears, providing esthetic benefits. The kit of FIGS. 6 and 7 can be provided with a template, just like the earlier-described one. It can also be installed using the same procedure, except that the female components 113*b* do not need to be handled separately.

FIGS. 6 and 7 also show elements of a door jamb reinforcing system. The value of such reinforcements is explained in my prior U.S. Pat. Nos. 5,070,650 and 8,132,832. They reinforce the door jamb to resist breakage of the door jamb if an intruder tries to bulldoze his way into a home by kicking and breaking the door. With both the door and the door jamb reinforced, forced entry becomes nearly impossible.

The door jamb reinforcing system of the current embodiment includes two reinforcing members, a first member 110 and a second member 210. The first reinforcing member 110 has a latch bolt receiving aperture 120 and an adjacent protruding strike plate ramp or tongue 130. The member 110 also preferably has at least one deadbolt latch bolt receiving aperture 125. The at least one deadbolt latch bolt receiving aperture 125 is formed above the latch bolt receiving aperture 120 an appropriate distance so as to be able to receive a deadbolt latch bolt within the deadbolt latch bolt receiving aperture 125, when installed on a door jamb. In various exemplary embodiments, the first reinforcing member 110 includes at least two deadbolt latch bolt receiving apertures 125. In these exemplary embodiments, the deadbolt latch bolt receiving apertures 125 are formed above and below the latch bolt receiving aperture 120 an appropriate distance so as to be able to receive a deadbolt latch bolt within the deadbolt latch bolt receiving aperture 125, whether installed on a right-handed door or a left-handed door. However, the deadbolt latch bolt receiving aperture(s) 125 may be formed in any area of the first reinforcing member 110 where appropriate to receive a deadbolt latch bolt within at least one of the deadbolt latch bolt receiving aperture(s) 125 when installed.

As shown in FIGS. 6 and 7, a second reinforcing member 210 comprises an elongate metal plate having a main body portion 211 and a lip portion 212, such that the second reinforcing member 210 has a substantially L-shaped cross section. The L-shaped cross section of the second reinforcing member 210 makes a form of "angle iron" that contributes to the overall rigidity of the second reinforcing member 210 and the door jamb reinforcing system 100.

Alternate materials of construction of the second reinforcing member 210 may include one or more of the following: steel, stainless steel, aluminum, titanium, and/or other metals, as well as various alloys and composites thereof.

The first and second reinforcing members 110 and 210 each have a plurality of spaced apart holes defining screw receiving openings 215 for mounting screws. The screw receiving openings 215 of each member 110 and 210 is positioned to align with corresponding to screw receiving openings of the other reinforcing member. In this manner, when an appropriate mounting screw is placed in one of the second screw receiving openings 215, the mounting screw can pass through the screw receiving openings of the two reinforcing members. The screw receiving openings 215 in the second reinforcing member 210 may be countersunk in order for the mounting screws, once installed, to be substantially flush with an exposed surface of the door jamb reinforcing system 100.

The second reinforcing member 210 further includes a first cut out area defining a strike plate tongue receiving aperture 220. The strike plate tongue receiving aperture 220 is sized and located so as to be able to receive the tongue 130 of the strike plate formed on the first reinforcing member 110.

The strike plate receiving aperture 220 is generally cut out to correspond to the location of the latch bolt receiving aperture 122. In this manner, when the first reinforcing member 110 and the second reinforcing member 210 are aligned so their apertures 120 and 122 are aligned, the tongue 130 passes through the aperture 220, and the nested plates 110 and 210 form a reinforcing member that has a built-in strike plate. My prior U.S. Pat. No. 8,132,832 also provided an integrated strike plate, but the version shown herein is much easier and less expensive to manufacture.

The second reinforcing member 210 may include at least one second cut out area defining at least one deadbolt latch bolt receiving aperture 225. The deadbolt latch bolt receiving aperture 225 is generally formed to correspond to the size and location of the deadbolt latch bolt receiving aperture 125. Preferably the aperture 225 is provided with a plug(s) 230 held in place by, for example, a plurality of connectors 235 that are relatively easy to break. Since the reinforcing member 210 covers the member 110 in normal installation, the plug 230 covers the hole in the underlying member 210, providing a relatively smooth surface. If that plug 230 corresponds with the location of a deadbolt, the plug 230 can be knocked out, leaving aligned holes 225 and 125. If the plug does not correspond with the deadbolt location, it can be left in place and the space that the plug 230 does not fill within a deadbolt latch bolt receiving aperture 225 can be filled in, if desired, with caulk, putty (or the like) upon completion of installation of the door jamb reinforcing system 100.

In this manner, when the first reinforcing member 110 and the second reinforcing member 210 are aligned, a deadbolt latch bolt may be received within the deadbolt latch bolt receiving aperture 225 of the second reinforcing member 210 and the deadbolt latch bolt receiving aperture 125 of the first reinforcing member 110.

The second reinforcing member 210 may include at least two deadbolt latch bolt receiving apertures 225. In these exemplary embodiments, the deadbolt latch bolt receiving apertures 225 are formed so as to correspond to the deadbolt latch receiving apertures 125 so as to be installable on a right-handed door or a left-handed door.

FIG. 7 shows a kit identical to the kit of FIG. 6, except the first and second reinforcing members 110 and 210 are shortened. In addition, FIG. 7 shows an element that is preferably included in the embodiment of FIG. 6, but not visible in the view depicted. The reinforcing member 210 includes a latch bolt adjustment tab 318 within the latch bolt aperture 122. The latch bolt adjustment tab 318 can be bent or otherwise manipulated to adjust the effective size of the latch bolt receiving aperture 122 to more snugly accept a latch bolt. This is typically done following installation and is intended to reduce or eliminate any door wiggle that may result from a latch bolt that is not entirely snug within the latch bolt receiving aperture 122.

Figure 8:
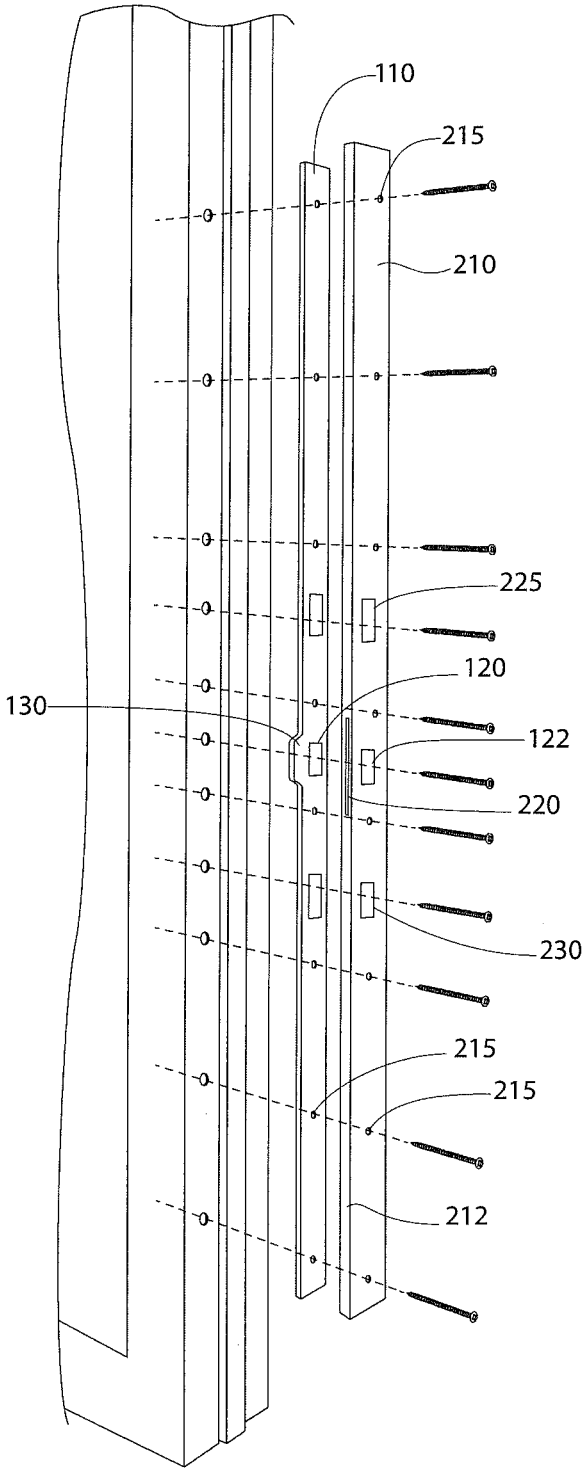
FIG. 8 is an exploded view showing how the door jamb reinforcement embodiment of FIG. 6 is installed on a door jamb.

As seen in FIG. 8, installation of the reinforcing members 110 and 210 on a door jamb includes removing the old hardware from the door jamb. Also remove any other items such as weather stripping from casing if needed. The reinforcing members 110 and 210 should be positioned in place to check for clearance issues.

The reinforcing member 210 is positioned on door casing with cut outs 220, 225 on center marks on door casing. The member 210 is held in place, and the door jamb under each hole 215 is drilled with a 5/32" drill bit to the depth of 2¼."

The caulking (if any) is removed from the door casing with a ridged putty knife. This allows the lip portion 212 to slip under the casing trim, which is not removed.

Members 110 and 210 are nested and positioned as one unit on the door casing, with the holes of both pieces lining up with each other.

Two and one-half inch long screws are inserted in top and bottom holes 215 and screwed in for 2¼". At this point, the two members 110 and 210 are aligned and held even while tightening the bottom screw all the way in.

The same procedure is followed with the remaining screws, remembering to stop at 2¼".

Finally, each screw is strengthened the remaining ¼", with the lip portion 212 going behind the door trim.

In some embodiments, the door jamb reinforcements are part of a kit with door edge reinforcements, and in other embodiments, each is offered separately. Maximum protection from bulldozing attack can be achieved when both are used together on a door jamb and its co-operating door.

Certain modifications and improvements will occur to those skilled in the art upon reading the foregoing description. It should be understood that all such modifications and improvements have been omitted for the sake of conciseness and readability, but are properly within the scope of the following claims.

What is claimed is:

1. A mechanism to be applied to a door jamb that is opposed by a co-operating door edge to strengthen the door jamb to survive forced entry efforts comprising a first elongated plate sized for mounting on a door jamb surface that is opposed by a co-operating door edge, the first plate having a protruding ramp configured to serve as a strike plate for a latch bolt mounted in a co-operating door and a bolt hole in the first plate proximate the ramp to receive the latch bolt when the co-operating door is closed, a second elongated plate having an inner overlay and an outer flange perpendicular to the inner overlay forming an L-shaped cross-section, a bolt hole in the inner overlay to receive the latch bolt when the co-operating door is closed, a slot in the outer flange proximate the bolt hole in the inner overlay sized to receive and surround the ramp of the first plate when the first plate is nested with the second plate and the bolt hole in the first plate and bolt hole in the inner overlay are aligned, both the first and second plates having holes that are sized to receive screws to hold the plates mounted to the door jamb and that are positioned in the first and second plates to align when the bolt holes in the first and second plates are aligned.

2. A mechanism as claimed in claim 1 wherein the first plate has at least one additional bolt hole for deadbolts and the second plate has at least one additional bolt hole for deadbolts.

3. The mechanism of claim 1 wherein the holes in the second plate that are sized to receive screws are countersunk.

4. The mechanism of claim 1 wherein the bolt hole in the second plate includes a latch bolt adjustment tab.

5. A kit for protecting against a breakage of a door jamb and cooperating door that has an installed door knob lock assembly including a latch bolt adjacent a door edge comprising a first elongated plate sized for mounting on a door jamb surface that is opposed by a co-operating door edge, the first plate having a protruding ramp configured to serve as a strike plate for the latch bolt mounted in the co-operating door and a bolt hole in the first plate proximate the ramp to receive the latch bolt when the co-operating door is closed, and a second elongated plate having an inner overlay and an outer flange perpendicular to the inner overlay forming an L-shaped cross-section, a bolt hole in the inner overlay to receive the latch bolt when the co-operating door is closed, a slot in the outer flange proximate the hole in the inner overlay sized to receive and surround the ramp of the first plate when the first plate is nested with the second plate and the bolt hole in the first plate and bolt hole in the inner overlay are aligned, both the first and second plates having holes that are sized to receive screws to hold the plates mounted to the door jamb and that are aligned when the bolt holes in the first and second plates are aligned, both the first and second plates having a width narrow enough for mounting on a door jamb surface that is opposed by a co-operating door edge; and first and second metal plates for mounting on the cooperating door having one length dimension long enough to span the door knob lock assembly to define upper and lower ends and having a width narrow enough to fit between a door knob and the door edge, the metal plates having a connection means to enable the first and second metal plates to be fastened to each other through holes in the cooperating door, thereby reinforcing the door around the door knob lock assembly to reduce the likelihood of door breakage during an attempted forced entry.

6. A kit as claimed in claim 5 wherein the connection means includes a hold near each of the upper and lower ends of the first and second metal plates, and two connectors that each include a male component and a female component, the male component having outer threads and the female component having inner threads, whereby the male component may be engaged to the female component, the female component having a shaft, one of the male and female components having a plain head so it cannot be engaged by a screwdriver and the other of the male and female components having a head that can be engaged by a screwdriver.

7. A kit as claimed in claim 5 wherein the connection means includes a hole near each of the upper and lower ends of the first metal plate, and female components surface mounted on the second metal plate and the kit further includes two male components, the male component having outer threads and the female component having a shaft with inner threads, whereby the male component may be engaged to the female component.

8. A kit as claimed in claim 5 further comprising a three-fold template having a first side to fit on an outside of the cooperating door, a second side to fit on the door edge and a third side to fit on an inside of the door, the second side of the template having a first guide to guide placement of the template so that a lockset latch bolt of the door knob lock assembly can pass through a hole in the template, thereby defining a locus for the template on the door, the template further having a second guide for placement of the metal plates on the door for mounting.

9. A kit as claimed in claim 5 wherein the first and second elongated plates have a length that extends at least two feet.

10. A kit as claimed in claim 5 wherein the metal plates are generally rectangular.

11. A kit as claimed in claim 5 wherein the first elongated plate has at least one additional bolt hole for deadbolts and the second plate has at least one additional bolt hole for deadbolts.

12. A kit as claimed in claim 5 wherein the holes in the second elongated plate that are sized to receive screws are countersunk.

13. A kit as claimed in claim 5 wherein the bolt hole in the second elongated plate includes a latch bolt adjustment tab.

14. A kit for protecting against a breakage of a door jamb and a co-operating door that has an installed door knob lock assembly including a latch bolt adjacent a door edge comprising an elongated, first plate having a protruding ramp configured to serve as a strike plate for the latch bolt mounted in the co-operating door and a bolt hole in the first plate proximate the ramp to receive the latch bolt when the co-operating door is closed, and an elongated, second plate having an inner overlay and an outer flange perpendicular to the inner overlay forming an L-shaped cross-section, a bolt hole in the inner overlay to receive the latch bold when the co-operating door is closed, a slot in the outer flange proximate the hole in the inner overlay sized to receive and surround the ramp of the first plate when the first plate is nested with the second plate and the bolt hole in the first plate and bolt hole in the inner overlay are aligned, both the first and second plates having holes that are sized to receive screws to hold the plates mounted to the door jamb and that are aligned when the bolt holes in the first and second plates are aligned, both the first and second plates having a width narrow enough for mounting on a door jamb surface that is opposed by the co-operating door edge and a length that extends at least two feet; and third and fourth shorter plates for mounting on the cooperating door having a length long enough to span the door knob lock assembly to define upper and lower ends, a connection means to enable the third and fourth plates to be fastened to each other through holes in the co-operating door, thereby reinforcing the door around the door knob lock assembly to reduce a likelihood of door breakage during an attempted forced entry, and a width narrow enough to fit between a door knob and the door edge and narrow enough so that when mounted to the co-operating door, the third and fourth plates do not extend past the edge of the door where they could collide with the installed second plate on the door jamb.

* * * * *

UNITED STATES PATENT AND TRADEMARK OFFICE

CERTIFICATE OF CORRECTION

PATENT NO. : 8,904,713 B1
APPLICATION NO. : 13/934740
DATED : December 9, 2014
INVENTOR(S) : Edward Anderson It is certified that error appears in the above-identified patent and that said Letters Patent is hereby corrected as shown below:

In the Specification

In Column 2, line 2, haves should be "have"

In the Claims

In column 10, line 25, bold should be "bolt"

Signed and Sealed this
Seventh Day of April, 2015

Michelle K. Lee

Michelle K. Lee
*Director of the United States Patent and Trademark Office*